US009848272B2

(12) United States Patent
Villemoes et al.

(10) Patent No.: US 9,848,272 B2
(45) Date of Patent: Dec. 19, 2017

(54) DECORRELATOR STRUCTURE FOR PARAMETRIC RECONSTRUCTION OF AUDIO SIGNALS

(71) Applicant: DOLBY INTERNATIONAL AB, Amsterdamn Zuidoost (NL)

(72) Inventors: Lars Villemoes, Stockholm (SE); Toni Hirvonen, Stockholm (SE); Heiko Purnhagen, Stockholm (SE)

(73) Assignee: Dolby International AB, Amsterdam (NL)

( * ) Notice: Subject to any disclaimer, the term of this patent is extended or adjusted under 35 U.S.C. 154(b) by 0 days.

(21) Appl. No.: 15/029,023

(22) PCT Filed: Oct. 21, 2014

(86) PCT No.: PCT/EP2014/072568

§ 371 (c)(1),
(2) Date: Apr. 13, 2016

(87) PCT Pub. No.: WO2015/059152

PCT Pub. Date: Apr. 30, 2015

(65) Prior Publication Data

US 2016/0261967 A1 Sep. 8, 2016

Related U.S. Application Data

(60) Provisional application No. 61/893,770, filed on Oct. 21, 2013, provisional application No. 61/973,646, filed on Apr. 1, 2014.

(51) Int. Cl.
*H04S 3/02* (2006.01)
*G10L 19/008* (2013.01)
(Continued)

(52) U.S. Cl.
CPC ..... *H04S 7/30* (2013.01); *G10L 19/002* (2013.01); *G10L 19/008* (2013.01); *G10L 25/21* (2013.01);
(Continued)

(58) Field of Classification Search
CPC .... G10L 19/008; G10L 19/20; H04S 2400/03
(Continued)

(56) References Cited

U.S. PATENT DOCUMENTS 6,498,857 B1 12/2002 Sibbald
7,394,903 B2 7/2008 Herre
(Continued)

FOREIGN PATENT DOCUMENTS

EP 2214162 8/2010
EP 2360681 8/2011
(Continued)

OTHER PUBLICATIONS

Vilkamo, J. et al "Optimized Covariance Domain Framework for Time-Frequency Processing of Spatial Audio" JAES vol. 61, Issue 6, pp. 403-411, Jul. 8, 2013.
(Continued)

*Primary Examiner* — George Monikang

(57) ABSTRACT

An encoding system encodes multiple audio signals (X) as a downmix signal (Y) together with wet and dry upmix coefficients (P, C). In a decoding system, a pre-multiplier (101) computes an intermediate signal (W) by mapping the downmix signal linearly in accordance with a first set of coefficients (Q); a decorrelating section (102) outputs a decorrelated signal (Z) based on the intermediate signal; a wet upmix section (103) computes a wet upmix signal by mapping the decorrelated signal linearly in accordance with the wet upmix coefficients; a dry upmix section (104) computes a dry upmix signal by mapping the downmix
(Continued)

signal linearly in accordance with the dry upmix coefficients; a combining section (105) provides a multidimensional reconstructed signal (X) by combining the wet and dry upmix signals; and a converter (106) computes the first set of coefficients based on the wet and dry upmix coefficients and supplies this to the pre-multiplier.

18 Claims, 2 Drawing Sheets

(51) Int. Cl.

| | |
|---|---|
| ***H04S 5/02*** | (2006.01) |
| ***H04S 3/00*** | (2006.01) |
| ***H04S 7/00*** | (2006.01) |
| ***G10L 19/002*** | (2013.01) |
| ***G10L 25/21*** | (2013.01) |

(52) U.S. Cl.
CPC ..... *H04S 2400/03* (2013.01); *H04S 2420/03* (2013.01)

(58) Field of Classification Search
USPC ..... 381/17–19, 22–23
See application file for complete search history.

(56) References Cited

U.S. PATENT DOCUMENTS

| | | | |
|---|---|---|---|
| 7,502,743 | B2 | 3/2009 | Thumpudi |
| 7,668,722 | B2 | 2/2010 | Villemoes |
| 7,965,848 | B2 | 6/2011 | Villemoes |
| 7,966,191 | B2 | 6/2011 | Schuijers |
| 7,986,789 | B2 | 7/2011 | Purnhagen |
| 8,019,350 | B2 | 9/2011 | Purnhagen |
| 8,019,614 | B2 | 9/2011 | Takagi |
| 8,170,882 | B2 | 5/2012 | Davis |
| 8,311,809 | B2 | 11/2012 | Schuijers |
| 8,325,929 | B2 | 12/2012 | Koppens |
| 8,340,302 | B2 | 12/2012 | Breebaart |
| 8,515,759 | B2 | 8/2013 | Engdegard |
| 8,626,503 | B2 | 1/2014 | Schuijers |
| 2007/0189426 | A1 | 8/2007 | Kim |
| 2007/0233293 | A1 | 10/2007 | Villemoes |
| 2009/0089479 | A1 | 4/2009 | Son |
| 2011/0096932 | A1 | 4/2011 | Schuijers |
| 2011/0182432 | A1 | 7/2011 | Ishikawa |
| 2012/0039477 | A1 | 2/2012 | Schijers |
| 2012/0314876 | A1 | 12/2012 | Vilkamo |
| 2013/0225128 | A1 | 8/2013 | Gomar |
| 2013/0230176 | A1 | 9/2013 | Virette |
| 2016/0111097 | A1 | 4/2016 | Purnhagen |

FOREIGN PATENT DOCUMENTS

| | | |
|---|---|---|
| EP | 2541546 | 1/2013 |
| JP | 2011-527456 | 10/2011 |
| JP | 2012-512438 | 5/2012 |
| JP | 2014-508316 | 4/2014 |
| JP | 2016-537669 | 12/2016 |
| KR | 10-2012-0121378 | 11/2012 |
| WO | 2007/078254 | 7/2007 |
| WO | 2007/081166 | 7/2007 |
| WO | 2008/131903 | 11/2008 |
| WO | 2010/149700 | 12/2010 |
| WO | 2013/124446 | 8/2013 |

OTHER PUBLICATIONS

Quackenbush, S. et al "MPEG Surround" IEEE Multimedia, vol. 12, Issue 4, pp. 18-23, Oct. 31, 2005.

Breebaart, J. et al "MPEG Spatial Audio Coding/MPEG Surround: Overview and Current Status" AES presented at the 119th Convention Oct. 7-10, 2005, New York, USA, pp. 1-17.

Villemoes, L. et al "MPEG Surround: The Forthcoming ISO Standard for Spatial Audio Coding" MPEG Surround: The Forthcoming ISO Standard, AES 28th International Conference, Pieta, Sweden, Jun. 30-Jul. 2, 2006, pp. 1-18.

Engdegard, J. et al "Spatial Audio Object Coding (SAOC)—The Upcoming MPEG Standard on Parametric Object Based Audio Coding", Journal of the Audio Engineering Society, May 17, 2008, pp. 1-16.

Hotho, G. et al "A Backward-Compatible Multichannel Audio Codec" IEEE Transactions on Audio, Speech, and Language Processing, vol. 16, Issue 1, pp. 83-93, published in Jan. 2008.

DECORRELATOR STRUCTURE FOR PARAMETRIC RECONSTRUCTION OF AUDIO SIGNALS

CROSS-REFERENCE TO RELATED APPLICATIONS

This application claims priority from U.S. Provisional Patent Applications Nos. 61/973,646 filed 1 Apr. 2014 and 61/893,770 filed 21 Oct. 2013, each of which is hereby incorporated by reference in its entirety.

TECHNICAL FIELD

The invention disclosed herein generally relates to encoding and decoding of audio signals, and in particular to parametric reconstruction of a plurality of audio signals from a downmix signal and associated metadata.

BACKGROUND

Audio playback systems comprising multiple loudspeakers are frequently used to reproduce an audio scene represented by a plurality of audio signals, wherein the respective audio signals are played back on respective loudspeakers. The audio signals may for example have been recorded via a plurality of acoustic transducers or may have been generated by audio authoring equipment. In many situations, there are bandwidth limitations for transmitting the audio signals to the playback equipment and/or limited space for storing the audio signals in a computer memory or on a portable storage device. There exist audio coding systems for parametric coding of audio signals, so as to reduce the bandwidth or storage size needed. On an encoder side, these systems typically downmix the audio signals into a downmix signal, which typically is a mono (one channel) or a stereo (two channels) downmix, and extract side information describing the properties of the audio signals by means of parameters like level differences and cross-correlation. The downmix and the side information are then encoded and sent to a decoder side. At the decoder side, the plurality of audio signals is reconstructed, i.e. approximated, from the downmix under control of the parameters of the side information. Decorrelators are often employed as part of parametric reconstruction for increasing the dimensionality of the audio content provided by the downmix, so as to allow a more faithful reconstruction of the plurality of audio signals. How to design and implement decorrelators may be key factors for increasing the fidelity of the reconstruction.

In view of the wide range of different types of devices and systems available for playback of a plurality of audio signals representing an audio scene, including an emerging segment aimed at end-users in their homes, there is a need for new and alternative ways to efficiently encode a plurality of audio signals, so as to reduce bandwidth requirements and/or the required memory size for storage, and/or to facilitate reconstruction of the plurality of audio signals at a decoder side.

BRIEF DESCRIPTION OF THE DRAWINGS

In what follows, example embodiments will be described in greater detail and with reference to the accompanying drawings, on which.

Figure 1:
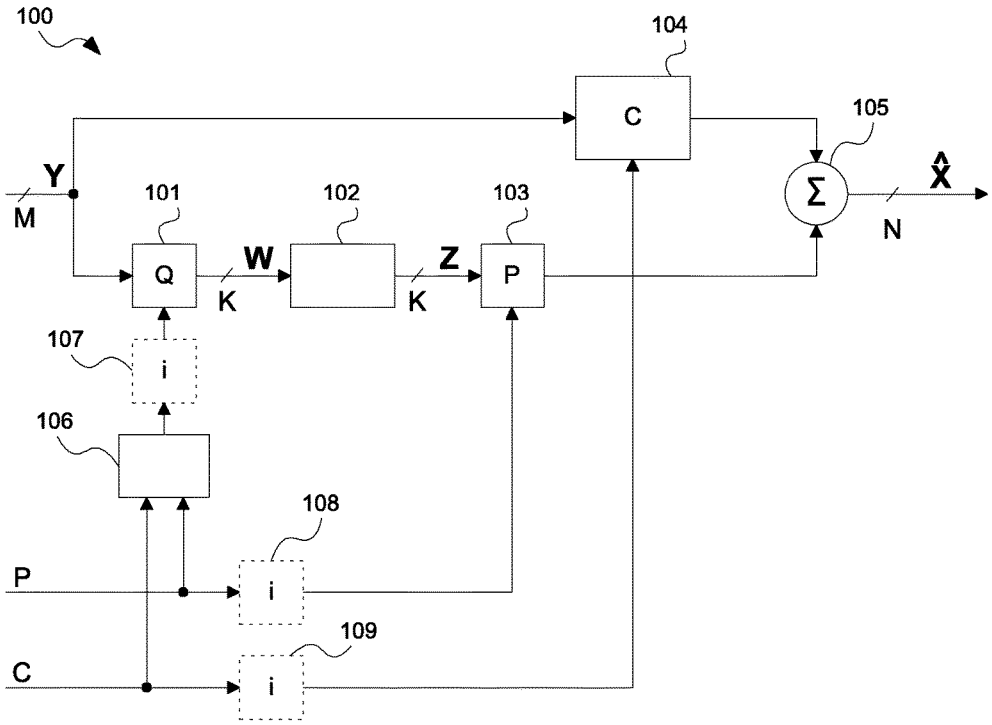
FIG. 1 is a generalized block diagram of a parametric reconstruction section for reconstructing a plurality of audio signals based on a downmix signal and associated wet and dry upmix coefficients, according to an example embodiment.

All the figures are schematic and generally only show parts which are necessary in order to elucidate the invention, whereas other parts may be omitted or merely suggested.

DESCRIPTION OF EXAMPLE EMBODIMENTS

As used herein, an audio signal may be a pure audio signal, an audio part of an audiovisual signal or multimedia signal or any of these in combination with metadata.

As used herein, a channel is an audio signal associated with a predefined/fixed spatial position/orientation or an undefined spatial position such as "left" or "right".

As used herein, an audio object or audio object signal is an audio signal associated with a spatial position susceptible of being time-variable, i.e. a spatial position whose value may be re-assigned or updated over time.

I. Overview

According to a first aspect, example embodiments propose audio decoding systems as well as methods and computer program products for reconstructing a plurality of audio signals. The proposed decoding systems, methods and computer program products, according to the first aspect, may generally share the same features and advantages.

According to example embodiments, there is provided a method for reconstructing a plurality of audio signals. The method comprises: receiving a time/frequency tile of a downmix signal together with associated wet and dry upmix coefficients, wherein the downmix signal comprises fewer channels than the number of audio signals to be reconstructed; computing a first signal with one or more channels, referred to as an intermediate signal, as a linear mapping of the downmix signal, wherein a first set of coefficients is applied to the channels of the downmix signal as part of computing the intermediate signal; generating a second signal with one or more channels, referred to as a decorrelated signal, by processing one or more channels of the intermediate signal; computing a third signal with a plurality of channels, referred to as a wet upmix signal, as a linear mapping of the decorrelated signal, wherein a second set of coefficients is applied to one or more channels of the decorrelated signal as part of computing the wet upmix signal; computing a fourth signal with a plurality of channels, referred to as a dry upmix signal, as a linear mapping of the downmix signal, wherein a third set of coefficients is applied to the channels of the downmix signal as part of computing the dry upmix signal; and combining the wet and dry upmix signals to obtain a multidimensional reconstructed signal corresponding to a time/frequency tile of the plurality of audio signals to be reconstructed. In the present example embodiment, the second and third sets of coefficients correspond to the received wet and dry upmix coefficients, respectively; and the first set of coefficients is computed, according to a predefined rule, based on the wet and dry upmix coefficients.

The addition of the decorrelated signal serves to increase the dimensionality of the content of the multidimensional reconstructed signal, as perceived by a listener, and to increase fidelity of the multidimensional reconstructed signal. Each of the one or more channels of the decorrelated signal may have at least approximately the same spectrum as a corresponding channel of the one or more channels of the intermediate signal, or may have spectra corresponding to a rescaled/normalized version of the spectrum of the corresponding channel of the one or more channels of the intermediate signal, and the one or more channels of the decorrelated signal may be at least approximately mutually uncorrelated. The one or more channels of the decorrelated signal may preferably be at least approximately uncorrelated to the one or more channels of the intermediate signal and the channels of the downmix signal. Although it is possible to synthesize mutually uncorrelated signals with a given spectrum from e.g. white noise, the one or more channels of the decorrelated signal, according to the present example embodiment, are generated by processing the intermediate signal, e.g. including applying respective all-pass filters to the respective one or more channels of the intermediate signal or recombining portions of the respective one or more channels of the intermediate signal, so as to preserve as many properties as possible, especially locally stationary properties, of the intermediate signal, including relatively more subtle, psycho-acoustically conditioned properties of the intermediate signal, such as timbre.

The inventors have realized that the choice of an intermediate signal, from which the decorrelated signal is derived, may affect the fidelity of the reconstructed audio signals, and that if certain properties of the audio signals to be reconstructed change, e.g. if the audio signals to be reconstructed are audio objects with time-varying positions, the fidelity of the reconstructed audio signals may be increased if the computations via which the intermediate signal is obtained are adapted accordingly. In the present example embodiment, computing the intermediate signal includes applying the first set of coefficients to the channels of the downmix signals, and the first set of coefficients therefore allows at least some control over how the intermediate signal is computed, which allows for increasing the fidelity of the reconstructed audio signals.

The inventors have further realized that the received wet and dry upmix coefficients, employed for computing the wet and dry upmix signals, respectively, carry information which may be employed to compute suitable values for the first set of coefficients. By computing the first set of coefficients, according to a predefined rule, based on the wet and dry upmix coefficients, the amount of information needed to enable reconstruction of the plurality of audio signals is reduced, allowing for a reduction of the amount of metadata transmitted together with the downmix signal from an encoder side. By reducing the amount of data needed for parametric reconstruction, the required bandwidth for transmission of a parametric representation of the plurality of audio signals to e reconstructed, and/or the required memory size for storing such a representation, may be reduced.

By the second and third set of coefficients corresponding to the received wet and dry upmix coefficients, respectively, is meant that the second and third sets of coefficients coincide with the wet and dry upmix coefficients, respectively, or that the second and third sets of coefficients are uniquely controlled by (or derivable from) the wet and dry upmix coefficients, respectively. For example, the second set of coefficients may be derivable from the wet upmix coefficients even if the number of wet upmix coefficients is lower than the number of coefficients in the second set of coefficients, e.g. if predefined formulas for determining the second set of confidents from the wet upmix coefficients are known at the decoder side.

Combining the wet and dry upmix signals may include adding audio content from respective channels of the wet upmix signal to audio content of the respective corresponding channels of the dry upmix signal, such as additive mixing on a per-sample or per-transform-coefficient basis.

By the intermediate signal being a linear mapping of the downmix signal is meant that the intermediate signal is obtained by applying a first linear transformation to the downmix signal. This first transformation takes a predefined number of channels as input and provides a predefined number of one or more channels as output, and the first set of coefficients includes coefficients defining the quantitative properties of this first linear transformation.

By the wet upmix signal being a linear mapping of the decorrelated signal is meant that the wet upmix signal is obtained by applying a second linear transformation to the decorrelated signal. This second transformation takes a predefined number of one or more channels as input and provides a predefined (second) number of channels as output, and the second set of coefficients include coefficients defining the quantitative properties of this second linear transformation.

By the dry upmix signal being a linear mapping of the downmix signal is meant that the dry upmix signal is obtained by applying a third linear transformation to the downmix signal. This third transformation takes a predefined (third) number of channels as input and provides a predefined number of channels as output, and the third set of coefficients includes coefficients defining the quantitative properties of this third linear transformation.

Audio encoding/decoding systems typically divide the time-frequency space into time/frequency tiles, e.g. by applying suitable filter banks to the input audio signals. By a time/frequency tile is generally meant a portion of the time-frequency space corresponding to a time interval and a frequency sub-band. The time interval may typically correspond to the duration of a time frame used in the audio encoding/decoding system. The frequency sub-band may typically correspond to one or several neighboring frequency sub-bands defined by the filter bank used in the encoding/decoding system. In the case the frequency sub-band corresponds to several neighboring frequency sub-bands defined by the filter bank, this allows for having non-uniform frequency sub-bands in the decoding/reconstruction process of the audio signal, for example wider frequency sub-bands for higher frequencies of the audio signal. In a broadband case, where the audio encoding/decoding system operates on the whole frequency range, the frequency sub-band of the time/frequency tile may correspond to the whole frequency range. The method, according the present example embodiment, is described in terms of steps for reconstructing the plurality of audio signals for one such time/frequency tile. However, it is to be understood that the method may be repeated for each time/frequency tile of the audio encoding/decoding system. Also, it is to be understood that several time/frequency tiles may be reconstructed simultaneously. Typically, neighboring time/frequency tiles may be disjoint or may partially overlap.

In an example embodiment, the intermediate signal, which is to be processed into the decorrelated signal, may be obtainable by a linear mapping of the dry upmix signal, i.e. the intermediate signal may be obtainable by applying a linear transformation to the dry upmix signal. By employing an intermediate signal obtainable by a linear mapping of the dry upmix signal which is computed as a linear mapping of the downmix signal, the complexity of the computations required for obtaining the decorrelated signal may be reduced, allowing for a computationally more efficient reconstruction of the audio signals. In at least some example embodiments, the dry upmix coefficients may have been determined at an encoder side such that the dry upmix signal computed at the decoder side approximates the audio signals to be reconstructed. Generation of the decorrelated signal based on an intermediate signal obtainable by a linear mapping of such an approximation may increase fidelity of the reconstructed audio signals.

In an example embodiment, the intermediate signal may be obtainable by applying to the dry upmix signal, a set of coefficients being absolute values of the wet upmix coefficients. The intermediate signal may for example be obtainable by forming the one or more channels of the intermediate signal as respective one or more linear combinations of the channels of the dry upmix signal, wherein the absolute values of the wet upmix coefficients may be applied to the respective dry upmix signal channels as gains in the one or more linear combinations. By employing an intermediate signal obtainable by mapping the dry upmix signal, by applying a set of coefficients being absolute values of the wet upmix coefficients, the risk of cancellation occurring in the intermediate signal between contributions from the respective channels of the dry upmix signal, due to the wet upmix coefficients having different signs, may be reduced. By reducing the risk of cancellation in the intermediate signal, the energy/amplitude of the decorrelated signal generated from the intermediate signal matches that of the audio signals as reconstructed, and sudden fluctuations in the wet upmix coefficients may be avoided or may occur less frequently.

In an example embodiment, the first set of coefficients may be computed by processing the wet upmix coefficients according to a predefined rule, and multiplying the processed wet upmix coefficients, and the dry upmix coefficients. For example, the processed wet upmix coefficients and the dry upmix coefficients may be arranged as respective matrices, and the first set of coefficients may correspond to a matrix computed as a matrix product of these two matrices.

In an example embodiment, the predefined rule for processing the wet upmix coefficients may include an element-wise absolute value operation.

In an example embodiment, the wet and dry upmix coefficients may be arranged as respective matrices, and the predefined rule for processing the wet upmix coefficients may include, in any order, computing element-wise absolute values of all elements and rearranging the elements to allow direct matrix multiplication with the matrix of dry upmix coefficients. In the present example embodiment, the audio signals to be reconstructed contribute to the one or more channels of the decorrelated signal via the downmix signal, on which the intermediate signal is based, and the one or more channels of the decorrelated signal contribute to the audio signals as reconstructed, via the wet upmix signal. The inventors have realized that in order to increase the fidelity of the audio signals as reconstructed, it may be desirable to strive to observe the following principle: the audio signals, to which a given channel of the decorrelated signal contributes in the parametric reconstruction, should contribute, via the downmix signal, to the same channel of the intermediate audio signal from which the given channel of the decorrelated signal is generated, and preferably by a matching/equivalent amount. The predefined rule, according to the present example embodiment, may be said to reflect this principle.

By including an element-wise absolute value operation in the predefined rule for processing the wet upmix coefficients, the risk of cancellation occurring in the intermediate signal between contributions from the respective channels of the dry upmix signal, due to the wet upmix coefficients having different signs, may be reduced. By reducing the risk of cancellation in the intermediate signal, the energy/amplitude of the decorrelated signal generated from the intermediate signal matches that of the audio signals as reconstructed, and sudden fluctuations in the wet upmix coefficients may be avoided or may occur less frequently.

In an example embodiment, the steps of computing and combining may be performed on a quadrature mirror filter (QMF) domain representation of the signals.

In an example embodiment, a plurality of values of the wet and dry upmix coefficients may be received, wherein each value is associated with a specific anchor point. In the present example embodiment, the method may further comprise: computing, based on values of the wet and dry upmix coefficients associated with two consecutive anchor points, corresponding values of the first set of coefficients, then interpolating a value of the first set of coefficients for at least one point in time comprised between the consecutive anchor points based on the values of the first set of coefficients already computed. In other words, the values of the first set of coefficients computed for the two consecutive anchor points are employed for interpolation between the two consecutive anchor points in order to obtain a value of the first set of coefficients for at least one point in time comprised between the two consecutive anchor points. This avoids unnecessary repetition of the relatively more costly computation of the first set of coefficients based on the wet and dry upmix coefficients.

According to example embodiments, there is provided an audio decoding system with a parametric reconstruction section adapted to receive a time/frequency tile of a downmix signal and associated wet and dry upmix coefficients, and to reconstruct a plurality of audio signals, wherein the downmix signal has fewer channels than the number of audio signals to be reconstructed. The parametric reconstruction section comprises: a pre-multiplier configured to receive the time/frequency tile of the downmix signal and to output an intermediate signal computed by mapping the downmix signal linearly in accordance with a first set of coefficients, i.e. by forming one or more linear combinations of the channels of the downmix signal employing the first set of coefficients; a decorrelating section configured to receive the intermediate signal and to output, based thereon, a decorrelated signal; a wet upmix section configured to receive the wet upmix coefficients as well as the decorrelated signal, and to compute a wet upmix signal by mapping the decorrelated signal linearly in accordance with the wet upmix coefficients, i.e. by forming linear combinations of the one or more channels of the decorrelated signal employing the wet upmix coefficients; a dry upmix section configured to receive the dry upmix coefficients and, in parallel to the pre-multiplier, the time/frequency tile of the downmix signal, and to output a dry upmix signal computed by mapping the downmix signal linearly in accordance with the dry upmix coefficients, i.e. by forming linear combinations of the channels of the downmix signal employing the dry upmix coefficients; and a combining section configured to receive the wet upmix signal and the dry upmix signal and to combine these signals to obtain a multidimensional reconstructed signal corresponding to a time/frequency tile of the plurality of audio signals to be reconstructed. The parametric reconstruction section further comprises a converter configured to receive the wet and dry upmix coefficients, to compute, according to a predefined rule, the first set of coefficients and to supply this, i.e. the first set of coefficients, to the pre-multiplier.

According to a second aspect, example embodiments propose audio encoding systems as well as methods and computer program products for encoding a plurality of audio signals. The proposed encoding systems, methods and computer program products, according to the second aspect, may generally share the same features and advantages. Moreover, advantages presented above for features of decoding systems, methods and computer program products, according to the first aspect, may generally be valid for the corresponding features of encoding systems, methods and computer program products according to the second aspect.

According to example embodiments, there is provided a method for encoding a plurality of audio signals as data suitable for parametric reconstruction. The method comprises: receiving a time/frequency tile of the plurality of audio signals; computing a downmix signal by forming linear combinations of the audio signals according to a downmixing rule, wherein the downmix signal comprises fewer channels than the number of audio signals to be reconstructed; determining dry upmix coefficients in order to define a linear mapping of the downmix signal approximating the audio signals to be encoded in the time/frequency tile; determining wet upmix coefficients based on a covariance of the audio signals as received and a covariance of the audio signals as approximated by the linear mapping of the downmix signal; and outputting the downmix signal together with the wet and dry upmix coefficients, which coefficients on their own enable computation according to a predefined rule of a further set of coefficients defining a pre-decorrelation linear mapping as part of parametric reconstruction of the audio signals. In this context, the pre-decorrelation linear mapping may for instance enable full or partial restoring of the covariance of the audio signals.

That the wet and dry upmix coefficients on their own enable computation according to the predefined rule of the further set of coefficients means that once (the values of) the wet and dry upmix coefficients are known, the further set of coefficients may be computed according to the predefined rule, without access to (values of) any additional coefficients sent from the encoder side. For example, the method may include outputting only the downmix signal, the wet upmix coefficients and the dry upmix coefficients.

On a decoder side, parametric reconstruction of the audio signals may typically include combining a dry upmix signal, obtained via the linear mapping of the downmix signal, with contributions from a decorrelated signal generated based on the downmix signal. By the further set of coefficients defining a pre-decorrelation linear mapping as part of parametric reconstruction of the audio signals is meant that the further set of coefficients includes coefficients defining the quantitative properties of a linear transformation taking the downmix signal as input and outputting a signal with one or more channels, referred to as an intermediate signal, on which a decorrelation procedure is performed to generate the decorrelated signal.

Since the further set of coefficients may be computed, according to the predefined rule, based on the wet and dry upmix coefficients, the amount of information needed to enable reconstruction of the plurality of audio signals is reduced, allowing for a reduction of the amount of metadata transmitted together with the downmix signal to a decoder side. By reducing the amount of data needed for parametric reconstruction, the required bandwidth for transmission of a parametric representation of the plurality of audio signals to be reconstructed, and/or the required memory size for storing such a representation, may be reduced.

The downmixing rule employed when computing the downmix signal defines the quantitative properties of the linear combinations of the audio signals, i.e. the coefficients to be applied to the respective audio signals when forming the linear combinations.

By the dry upmix coefficients defining a linear mapping of the downmix signal approximating the audio signals to be encoded is meant that the dry upmix coefficients are coefficients defining the quantitative properties of a linear transformation taking the downmix signal as input and outputting a set of audio signals approximating the audio signals to be encoded. The determined set of dry upmix coefficients may for example define a linear mapping of the downmix signal corresponding to a minimum mean square error approximation of the audio signal, i.e. among the set of linear mappings of the downmix signal, the determined set of dry upmix coefficients may define the linear mapping which best approximates the audio signal in a minimum mean square sense.

The wet upmix coefficients may for example be determined based on a difference between, or by comparing, a covariance of the audio signals as received and a covariance of the audio signals as approximated by the linear mapping of the downmix signal.

In an example embodiment, a plurality of time/frequency tiles of the audio signals may be received, and the downmix signal may be computed uniformly according to a predefined downmixing rule. In other words, the coefficients applied to the respective audio signals when forming the linear combinations of the audio signals are predefined and constant over consecutive time frames. For example, the downmixing rule may be adapted for providing a backward-compatible downmix signal, i.e. for providing a downmix signal which may be played back on legacy playback equipment employing a standardized channel configuration.

In an example embodiment, a plurality of time/frequency tiles of the audio signals may be received, and the downmix signal may be computed according to a signal-adaptive downmixing rule. In other words, at least one of the coefficients applied when forming the linear combinations of the audio signals is signal-adaptive, i.e. the value of at least one, and preferably several, of the coefficients may be adjusted/selected by the encoding system based on the audio content of one or more of the audio signals.

In an example embodiment, the wet upmix coefficients may be determined by: setting a target covariance to supplement the covariance of the audio signals as approximated by the linear mapping of the downmix signal; decomposing the target covariance as a product of a matrix and its own transpose, wherein the elements of the matrix, after optional column-wise rescaling, correspond to the wet upmix coefficients. In the present example embodiment, the matrix into which the target covariance is decomposed, i.e. which when multiplied by its own transpose yields the target covariance, may be a square matrix or a non-square matrix. According to at least some example embodiments, the target covariance may be determined based on one or more eigenvectors of a matrix formed as a difference between a covariance matrix of the audio signals as received and a covariance matrix of the audio signals as approximated by the linear mapping of the downmix signal.

In an example embodiment, the method may further comprise column-wise rescaling of the matrix, into which the target covariance is decomposed, i.e. the target covariance is decomposed as a product of a matrix and its own transpose, wherein the elements of the matrix, after column-wise rescaling, correspond to the wet upmix coefficients. In the present example embodiment, the column-wise rescaling may ensure that the variance of each signal resulting from an application of the pre-decorrelation linear mapping to the downmix signal is equal to the inverse square of a corresponding rescaling factor employed in the column-wise rescaling, provided the coefficients defining the pre-decorrelation linear mapping are computed in accordance with the predefined rule. The pre-decorrelation linear mapping may be employed at a decoder side to generate a decorrelated signal for supplementing the downmix signal in parametric reconstruction of the audio signals to be reconstructed. With the column-wise rescaling according to the present example embodiment, the wet upmix coefficients define a linear mapping of the decorrelated signal providing a covariance corresponding to the target covariance.

In an example embodiment, the predefined rule may imply a linear scaling relationship between the further set of coefficients and the wet upmix coefficients, and the column-wise rescaling may amount to multiplication by the diagonal part of the matrix product $$(\text{abs } V)^T C R_{yy} C^T \text{abs} V$$

raised to the power −¼, wherein abs V denotes the element-wise absolute value of the matrix into which the target covariance is decomposed, and $CR_{yy}C^T$ is a matrix corresponding to the covariance of the audio signals as approximated by the linear mapping of the downmix signal. By the diagonal part of a given matrix, e.g. of the above matrix product, is meant the diagonal matrix obtained by setting all off-diagonal elements to zero in the given matrix. By raising such a diagonal matrix to the power −¼ is meant that each of the matrix elements in the diagonal matrix is raised to the power −¼. The linear scaling relationship between the further set of coefficients and the wet upmix coefficients may for example be such that the column-wise rescaling of the matrix into which the target covariance is decomposed corresponds to a row-wise or column-wise rescaling of a matrix having the further set of coefficients as matrix elements, wherein the row-wise or column-wise rescaling of the matrix having the further set of coefficients as matrix elements employs the same rescaling factors as employed in the column-wise rescaling of the matrix into which the target covariance is decomposed.

The pre-decorrelation linear mapping may be employed at a decoder side to generate a decorrelated signal for supplementing the downmix signal in parametric reconstruction of the audio signals to be reconstructed. With the column-wise rescaling according to the present example embodiment, the wet upmix coefficients define a linear mapping of the decorrelated signal providing a covariance corresponding to the target covariance, provided the coefficients defining the pre-decorrelation linear mapping are computed in accordance with the predefined rule.

In an example embodiment, the target covariance may be chosen in order for the sum of the target covariance and the covariance of the audio signals as approximated by the linear mapping of the downmix signal to approximate, or at least substantially coincide with, the covariance of the audio signals as received, allowing for the audio signals as parametrically reconstructed at a decoder side, based on the downmix signal and the wet and dry upmix parameters, to have a covariance approximating, or at least substantially coinciding with, the covariance of the audio signals as received.

In an example embodiment, the method may further comprise performing energy compensation by: determining a ratio of an estimated total energy of the audio signals as received and an estimated total energy of the audio signals as parametrically reconstructed based on the downmix signal, the wet upmix coefficients and the dry upmix coefficients; and rescaling the dry upmix coefficients by the inverse square root of the ratio. In the present example embodiment, the rescaled dry upmix coefficients may be output together with the downmix signal and the wet upmix coefficients. In at least some example embodiments, the predefined rule may imply a linear scaling relationship between the further set of coefficients and the dry upmix coefficients, so that energy compensation performed on the dry upmix coefficients has a corresponding effect in the further set of coefficients. Energy compensation, according to the present example embodiment, allows for the audio signals as parametrically reconstructed at a decoder side, based on the downmix signal and the wet and dry upmix parameters, to have a total energy approximating a total energy of the audio signals as received.

In at least some example embodiment, the wet upmix coefficients may be determined prior to performing the energy compensation, i.e. the wet upmix coefficients may be determined based on wet upmix coefficients which have not yet been energy compensated.

According to example embodiments, there is provided an audio encoding system including a parametric encoding section adapted to encode a plurality of audio signals as data suitable for parametric reconstruction. The parametric encoding section comprises: a downmix section configured to receive a time/frequency tile of the plurality of audio signals and to compute a downmix signal by forming linear combinations of the audio signals according to a downmixing rule, wherein the downmix signal comprises fewer channels than the number of audio signals to be reconstructed; a first analyzing section configured to determine dry upmix coefficients in order to define a linear mapping of the downmix signal approximating the audio signals to be encoded in the time/frequency tile; and a second analyzing section configured to determine wet upmix coefficients based on a covariance of the audio signals as received and a covariance of the audio signals as approximated by the linear mapping of the downmix signal. In the present example embodiment, the parametric encoding section is configured to output the downmix signal together with the wet and dry upmix coefficients, wherein the wet and dry upmix coefficients on their own enable computation according to a predefined rule of a further set of coefficients defining a pre-decorrelation linear mapping as part of parametric reconstruction of the audio signals.

According to example embodiments, there is provided a computer program product comprising a computer-readable medium with instructions for performing any of the methods within the first and second aspects.

According to an example embodiment, at least one in the plurality of audio signals may relate to, or may be used to represent, an audio object signal associated with a spatial locator, i.e. although the plurality of audio signals may include e.g. channels associated with static spatial positions/orientations, the plurality of audio signals may also include one or more audio objects associated with a time-variable spatial position.

Further example embodiments are defined in the dependent claims. It is noted that example embodiments include all combinations of features, even if recited in mutually different claims.

II. Example Embodiments

Below, a mathematical description of encoding and decoding is provided. For a more detailed theoretical background, see the paper "A Backward-Compatible Multichannel Audio Codec", by Hotho et al., in IEEE Transactions on Audio, Speech, and Language Processing, Vol. 16, No. 1, January 2008.

At an encoder side, which will be described with reference to FIGS. 3 and 4, a downmix signal $Y=[y_1 \ldots y_M]^T$ is computed by forming linear combinations of a plurality of audio signals $x_n$,n=1, . . . , N, according to $$Y=\begin{bmatrix} y_1 \\ y_2 \\ \vdots \\ y_M \end{bmatrix}=\begin{bmatrix} d_{11} & \cdots & d_{1,N} \\ d_{21} & \cdots & d_{2,N} \\ \vdots & \ddots & \vdots \\ d_{M,1} & \cdots & d_{M,N} \end{bmatrix}\begin{bmatrix} x_1 \\ x_2 \\ \vdots \\ x_N \end{bmatrix}=DX, \tag{1}$$

where $d_{n,m}$ are downmix coefficients represented by a downmix matrix D, and where the audio signals $x_n$,n=1, . . . , N have been collected in a matrix $X=[x_1 \ldots x_N]^T$. The downmix signal Y includes M channels and the plurality of audio signals X includes N audio signals, where N>M>1. At a decoder side, which will be described with reference to FIGS. 1 and 2, parametric reconstruction of the plurality of audio signals X is performed according to $$\hat{X}=\begin{bmatrix} c_{11} & \cdots & c_{1,M} \\ c_{21} & \cdots & c_{2,M} \\ \vdots & \ddots & \vdots \\ c_{N,1} & \cdots & c_{N,M} \end{bmatrix}Y+\begin{bmatrix} p_{11} & \cdots & p_{1,K} \\ p_{21} & \cdots & p_{2,K} \\ \vdots & \ddots & \vdots \\ p_{N,1} & \cdots & p_{N,K} \end{bmatrix}\begin{bmatrix} z_1 \\ \vdots \\ z_K \end{bmatrix}=CY+PZ, \tag{2}$$

where $c_{n,m}$ are dry upmix coefficients represented by a matrix dry upmix matrix C, $p_{n,k}$ are wet upmix coefficients represented by a wet upmix matrix P, and $z_k$ are the K channels of a decorrelated signal $Z=[z_1 \ldots z_K]^T$, where K≥1. The decorrelated signal Z is generated based on an intermediate signal $W=[w_1 \ldots w_K]^T$ obtained as $$W=\begin{bmatrix} q_{11} & \cdots & q_{1,M} \\ q_{21} & \cdots & q_{2,M} \\ \vdots & \ddots & \vdots \\ q_{K,1} & \cdots & q_{K,M} \end{bmatrix}\begin{bmatrix} y_1 \\ \vdots \\ y_M \end{bmatrix}=QY, \tag{3}$$

where the coefficients $q_{k,m}$ are represented by a pre-decorrelation matrix Q defining a a pre-decorrelation linear mapping of the downmix signal Y. The K channels of the decorrelated signal Z are obtained from the respective K channels of the intermediate signal W via a decorrelation operation which preserves the energies/variances of the respective channels of the intermediate signal W but makes the channels of the decorrelated signal Z mutually uncorrelated, i.e. the decorrelated signal Z may be expressed as $$Z=\mathrm{decorr}(W). \tag{4}$$

where decorr( ) denotes this decorrelation operation.

As can be seen in equations (1), (3) and (4), the audio signals to be reconstructed X contribute to the channels of the decorrelated signal Z via the downmix signal Y and the intermediate signal W, and as can be seen in equation (2), the channels of the decorrelated signal Z contribute to the audio signals as reconstructed $\hat{X}$, via the wet upmix signal DZ. The inventors have realized that in order to increase the fidelity of the audio signals as reconstructed $\hat{X}$, it may be desirable to strive to observe the following principle:

the audio signals, to which a given channel of the decorrelated signal Z contributes in the parametric reconstruction, should contribute, via the downmix signal Y, to the same channel of the intermediate audio signal W from which the given channel of the decorrelated signal Z is generated, and preferably by a corresponding/matching amount.

One approach to observing this principle is to compute the pre-decorrelation coefficients Q according to $$Q=(\mathrm{abs}P)^T C \tag{5}$$

where abs P denotes the matrix obtained by taking absolute values of the elements of the wet upmix matrix P. Equations (3) and (5) imply that the intermediate signal W, which is to be processed into the decorrelated signal Z, is obtainable by a linear mapping of the "dry" upmix signal CY, which may be regarded as an approximation of the audio signals X to be reconstructed. This reflects the above described principle for deriving the decorrelated signal Z. The rule (5) for computing pre-decorrelation coefficients Q only involves computations with relatively low complexity and may therefore be conveniently employed at a decoder side. Alternative ways to compute the pre-decorrelation coefficients Q based on the dry upmix coefficients C and wet upmix coefficients P are envisaged. For example, it may be computed as $Q=(\mathrm{abs}\ P_0)^T C$, where the matrix $P_0$ is obtained by normalizing each column of P. An effect of this alternative way to compute the pre-decorrelation coefficients Q is that the parametric reconstruction provided via equation (2) scales linearly with the magnitude of the wet upmix matrix P.

The dry upmix coefficients C may for example be determined by computing the best possible "dry" upmix signal CY in the least squares sense, i.e. by solving the normal equations $$CYY^T=XY^T. \tag{6}$$

The covariance matrix of the audio signals as approximated by the dry upmix CY may be compared with the covariance matrix $R_{xx}$ of the audio signals X to be reconstructed, by forming $$\Delta R=R_{xx}-CR_{yy}C^T, \tag{7}$$

where $R_{yy}$ is the covariance matrix of the downmix signal Y and ΔR is the "missing" covariance which may be fully or partially provided by the "wet" upmix signal PZ. The missing covariance ΔR can be analyzed via eigendecomposition, i.e. based on its eigenvalues and associated eigenvectors. If parametric reconstruction according to equation (2) is to be performed at a decoder side, employing no more than K decorrelators, i.e. with a decorrelated signal Z having K channels, a target covariance $R_{wet}$ may be set for the wet upmix signal PZ by only keeping those parts of the eigendecomposition of ΔR which correspond to the K eigenvectors associated with the largest eigenvalue magnitudes, i.e. by removing those parts of the missing covariance ΔR corresponding to the other eigenvectors. If the downmix matrix D employed at the encoder side, according to equation (1), is non-degenerate, it can be shown that the missing covariance ΔR has rank at most N−M, and that no more than K=N−M decorrelators are needed to provide the full missing covariance ΔR. For a proof, see for example the paper "A Backward-Compatible Multichannel Audio Codec", by Hotho et al., in *IEEE Transactions on Audio, Speech, and Language Processing*, Vol. 16, No. 1, January 2008. By keeping contributions associated with the largest eigenvalues, perceptually important/significant portions of the missing covariance ΔR may be reproduced by the wet upmix signal PZ, even if only a smaller number K<N−M of decorrelators is employed on the decoder side. In particular, already the use of a single decorrelator, i.e., K=1, provides a significant improvement of the fidelity of the reconstructed audio signals, as compared to parametric reconstruction without decorrelation, for a relatively low additional cost in computational complexity at a decoder side. By increasing, i.e. the number of decorrelators, the fidelity of the reconstructed audio signals may be increased at the cost of additional wet upmix parameters P to be transmitted. The number of downmix channels M employed, and the number of decorrelators K employed, may e.g. be chosen based on a target bitrate for transmitting data to a decoder side and the required fidelity/quality of the reconstructed audio signals.

Given that the target covariance $R_{wet}$ has been set based on parts of the missing covariance ΔR associated with K eigenvalues, the target covariance $R_{wet}$ can be decomposed as $$R_{wet}=VV^T, \tag{8}$$

where V is a matrix with N rows and K columns, and the wet upmix matrix P may be obtained in the form $$P=VS, \tag{9}$$

where S is a diagonal matrix with positive elements providing column-wise rescaling of the matrix V. For a wet upmix matrix P having the form (9) and a dry upmix matrix C solving equation (6), the covariance matrix of the reconstructed signals $\hat{X}$ may be expressed as $$\hat{R}=CR_{yy}C^T+VS\mathrm{diag}(QR_{yy}Q)S^TV^T=R_{dry}+R_{wet},$$

where diag( ) denotes the operation of setting all off-diagonal elements of a matrix to zero. The condition for the wet upmix signal PZ to meet the target covariance $R_{wet}$ may therefore be expressed as $$VS\mathrm{diag}(QR_{yy}Q^T)S^TV^T=VV^T, \tag{10}$$

which is fulfilled if the column-wise rescaling given by the matrix S ensures that the variance of each signal resulting from an application of the pre-decorrelation linear mapping to the downmix signal Y, i.e. the channels of the intermediate signal W obtained via equation (3) which have the diagonal elements of $QR_{yy}Q^T$ as variances, is equal to the inverse square of a corresponding column-wise rescaling factor in the matrix S. With a pre-decorrelation matrix Q having the form (5), there is a linear scaling relationship between the wet upmix coefficients P and the pre-decorrelation coefficients Q allowing multiple instances of the matrix S to be gathered in equation (10), resulting in the sufficient condition $$S^4\mathrm{diag}((\mathrm{abs}\,V)^TCR_{yy}C^T(\mathrm{abs}\,V))=I,$$

where I is the identity matrix. Hence, the wet upmix coefficients P may be obtained as P=VS, where $$S=((\mathrm{abs}\,V)^TCR_{yy}C^T(\mathrm{abs}\,V))^{-1/4}. \tag{11}$$

Figure 3:
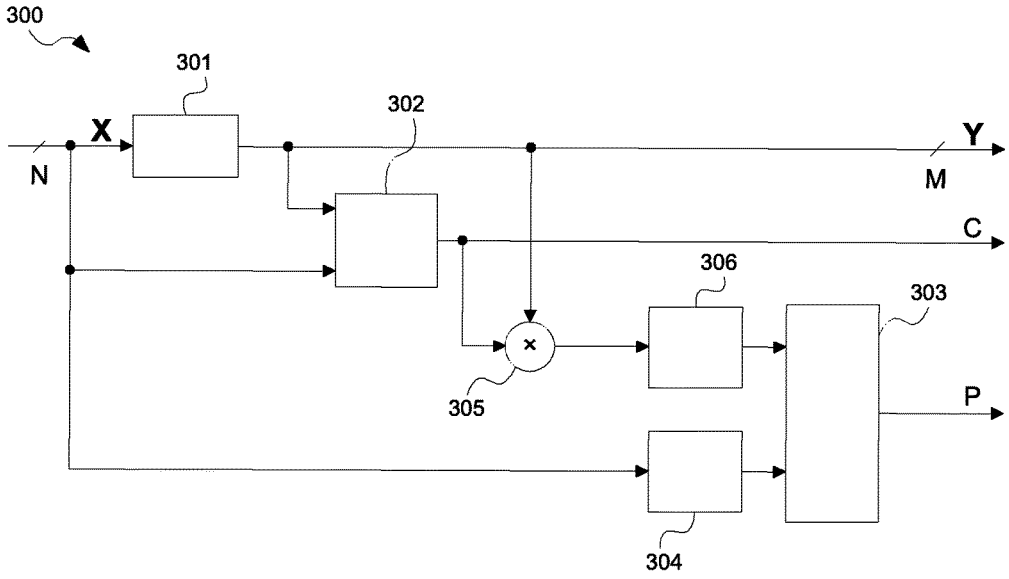
FIG. 3 is a generalized block diagram of a parametric encoding section for encoding a plurality of audio signals as a data suitable for parametric reconstruction, according to an example embodiment.

FIG. 3 is a generalized block diagram of a parametric encoding section 300 according to an example embodiment. The parametric encoding section 300 is configured to encode a plurality of audio signals $X=[x_1 \ldots x_N]^T$ as data suitable for parametric reconstruction according to equation (2). The parametric encoding section 300 comprises a downmix section 301, which receives a time/frequency tile of the plurality of audio signals X and computes a downmix signal $Y=[y_1 \ldots y_M]^T$ by forming linear combinations of the audio signals X according to equation (1), wherein the downmix signal Y comprises fewer channels M than the number N of audio signals X to be reconstructed. In the present example embodiment, the plurality of audio signals X includes audio object signals associated with time-variable spatial positions, and the downmix signal Y is computed according to a signal-adaptive rule, i.e. the downmix coefficients D employed when forming the linear combinations according to equation (1) depend on the audio signals X. In the present example embodiment, the downmix coefficients D are determined by the downmix section 301 based on the spatial positions associated with the audio objects included in the plurality of audio signals X, so as to ensure that objects located relatively far apart are encoded into different channels of the downmix signal Y, while objects located relatively close to each other may be encoded into the same channel of the downmix signal Y. An effect of such a signal-adaptive downmixing rule is that it facilitates reconstruction of the audio object signals at a decoder side, and/or enables a more faithful reconstruction of the audio object signals, as perceived by a listener.

In the present example embodiment, a first analyzing section 302 determines dry upmix coefficients, represented by the dry upmix matrix C, in order to define a linear mapping of the downmix signal Y approximating the audio signals X to be reconstructed. This linear mapping of the downmix signal Y is denoted by CY in equation (2). In the present example embodiment, the dry upmix coefficients C are determined according to equation (6) such that the linear mapping CY of the downmix signal Y corresponds to a minimum mean square approximation of the audio signals X to be reconstructed. A second analyzing section 303 determines wet upmix coefficients, represented by a wet upmix matrix P, based on the covariance matrix of the audio signal X as received and the covariance matrix of the audio signal as approximated by the linear mapping CY of the downmix signal Y, i.e. based on the missing covariance ΔR in equation (7). In the present example embodiment, a first processing section 304 computes the covariance matrix of the audio signal X as received. A multiplication section 305 computes the linear mapping CY of the downmix signal Y by multiplying the downmix signal Y and the wet upmix matrix C, and provides it to a second processing section 306 which computes the covariance matrix of the audio signal as approximated by the linear mapping CY of the downmix signal Y.

In the present example embodiment, the determined wet upmix coefficients P are intended for parametric reconstruction according to equation (2), with a decorrelated signal Z having K channels. The second analyzing section 303 therefore sets the target covariance $R_{wet}$ based on K eigenvectors associated with the largest (magnitudes of) eigenvalues of the missing covariance ΔR in equation (7), and decomposes the target covariance $R_{wet}$ according to equation (8). The wet upmix coefficients P are then obtained from the matrix V into which the target covaranice $R_{wet}$ was decomposed, after column-wise rescaling by the matrix S, according to equations (9) and (11). In the present example embodiment, a further set of coefficients Q, referred to as pre-decorrelation coefficients, are derivable from the dry upmix coefficients C and wet upmix coefficients P according to equation (5), and defines the pre-decorrelation linear mapping of the downmix signal Y given by equation (3).

In the present example embodiment, $K<N-M$, so that the wet upmix signal PZ does not provide the full missing covariance $\Delta R$ in equation (7). Hence, the reconstructed audio signals $\hat{X}$ typically has lower energy than the audio signals to be reconstructed X, and the first analyzing section 302 may optionally perform energy compensation by rescaling the dry upmix coefficients CY after the wet upmix coefficients have been determined by the second analyzing section 303. In example embodiments where instead $K=N-M$, the wet upmix signal PZ may provide the full missing covariance $\Delta R$ in equation (7) and there may be no use for energy compensation.

If energy compensation is to be performed, the first analyzing section 302 determines a ratio of an estimated total energy of the audio signals as received X and an estimated total energy of the audio signals as reconstructed $\hat{X}$ according to equation (2), i.e. based on the downmix signal Y, the wet upmix coefficients P and the dry upmix coefficients C. The first analyzing section 302 then rescales the previously determined dry upmix coefficients C by the inverse square root of the determined ratio. The parametric encoding section 300 then outputs the downmix signal Y together with the wet upmix coefficients P and the rescaled dry upmix coefficients C. Since the pre-decorrelation coefficients Q are determined according to the predefined rule given by equation (5), there is a linear scaling relationship between the dry upmix coefficients C and the pre-decorrelation coefficients Q. Hence, the rescaling of the dry upmix coefficients C causes a rescaling of both the dry upmix signal CY and the wet upmix signals PZ during parametric reconstruction at a decoder side according to equation (2).

Figure 4:
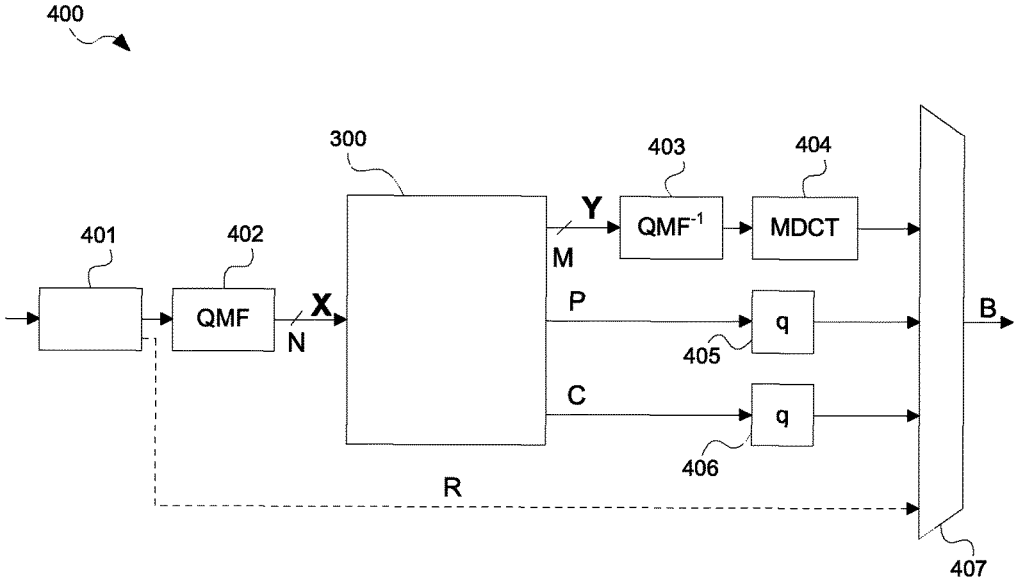
FIG. 4 is a generalized block diagram of an audio encoding system comprising the parametric encoding section depicted in FIG. 3, according to an example embodiment.

FIG. 4 is a generalized block diagram of an audio encoding system 400 according to an example embodiment, comprising the parametric encoding section 300 described with reference to FIG. 3. In the present example embodiment, audio content, e.g. recorded by one or more acoustic transducers 401 or generated by audio authoring equipment 401, is provided in the form of the plurality of audio signals X. A quadrature mirror filter (QMF) analysis section 402 transforms the audio signal X, time segment by time segment, into a QMF domain for processing by the parametric encoding section 300 of the audio signal X in the form of time/frequency tiles. The use of a QMF domain is suitable for processing of audio signals, e.g. for performing up/down-mixing and parametric reconstruction, and allows for approximately lossless reconstruction of audio signals at a decoder side.

The downmix signal Y output by the parametric encoding section 300 is transformed back from the QMF domain by a QMF synthesis section 403 and is transformed into a modified discrete cosine transform (MDCT) domain by a transform section 404. Quantization sections 405 and 406 quantize the dry upmix coefficients C and wet upmix coefficients C, respectively. For example, uniform quantization with a step size of 0.1 or 0.2 (dimensionless) may be employed, followed by entropy coding in the form of Huffman coding. A coarser quantization with step size 0.2 may for example be employed to save transmission bandwidth, and a finer quantization with step size 0.1 may for example be employed to improve fidelity of the reconstruction at a decoder side. The MDCT-transformed downmix signal Y and the quantized dry upmix coefficients C and wet upmix coefficients P are then combined into a bitstream B by a multiplexer 407, for transmission to a decoder side. The audio encoding system 400 may also comprise a core encoder (not shown in FIG. 4) configured to encode the downmix signal Y using a perceptual audio codec, such as Dolby Digital or MPEG AAC, before the downmix signal Y is provided to the multiplexer 407.

Since the plurality of audio signals X includes audio object signals associated with time-variable spatial positions or spatial locators, rendering metadata R including such spatial locators may for example be encoded in the bitstream B by the audio encoding system 400, for rendering of the audio object signals at a decoder side. The rendering metadata R may for example be provided to the multiplexer 407 by audio authoring equipment 401 employed to generate the plurality of audio signals X.

FIG. 1 is a generalized block diagram of a parametric reconstruction section 100, according to an example embodiment, adapted to reconstruct the plurality of audio signals X based on the downmix signal Y and associated wet upmix coefficients P and dry upmix coefficients C. A pre-multiplier 101 receives a time/frequency tile of the downmix signal Y and outputs an intermediate signal W computed by mapping the downmix signal linearly in accordance with a first set of coefficients, i.e. according to equation (3), wherein the first set of coefficients is the set of pre-decorrelation coefficients represented by the pre-decorrelation matrix Q. A decorrelating section 102 receives the intermediate signal W and outputs, based thereon, a decorrelated signal $Z=[z_1 \ldots z_K]^T$. In the present example embodiment, the K channels of the decorrelated signal Z are derived by processing the K channels of the intermediate signal W, including applying respective all-pass filters to the channels of the intermediate signal W, so as to provide channels that are mutually uncorrelated, and with audio content which is spectrally similar to and is also perceived as similar to that of the intermediate audio signal W by a listener. The decorrelated signal Z serves to increase the dimensionality of the reconstructed version $\hat{X}$ of the plurality of audio signals X, as perceived by a listener. In the present example embodiment, the channels of the decorrelated signal Z have at least approximately the same energies or variances as that of the respective channels of the intermediate audio signal W. A wet upmix section 103 receives the wet upmix coefficients P as well as the decorrelated signal Z and computes a wet upmix signal by mapping the decorrelated signal Z linearly in accordance with the wet upmix coefficients P, i.e. according to equation (2), where the wet upmix signal is denoted by PZ. A dry upmix section 104 receives the dry upmix coefficients C and, in parallel to the pre-multiplier 101, also the time/frequency tile of the downmix signal Y. The dry upmix section 103 outputs a dry upmix signal, denoted by CY in equation (2), computed by mapping the downmix signal Y linearly in accordance with the set of dry upmix coefficients C. A combining section 105 receives the dry upmix signal CY and the wet upmix signal PZ and combines these signals to obtain a multidimensional reconstructed signal $\hat{X}$ corresponding to a time/frequency tile of the plurality of audio signals X to be reconstructed. In the present example embodiment, the combining section 105 obtains the multidimensional reconstructed signal $\hat{X}$ by combining the audio content of the respective channels of the dry upmix signal CY with the respective channels of the wet upmix signal PZ, according to equation (2). The parametric reconstruction section 100 further comprises a converter 106 which receives the wet upmix coefficients P and the dry upmix coefficients C, and computes, according to the predefined rule given by equation (5), the first set of coefficients, i.e. the pre-decorrelation coefficients Q, and supplies the first set of coefficients Q to the pre-multiplier 101.

In the present example embodiment, the parametric reconstruction section 100 may optionally employ interpolation. For example, the parametric reconstruction section 100 may receive a plurality of values of the wet and dry upmix coefficients P, C, where each value is associated with a specific anchor point. The converter 106 computes, based on values of the wet and dry upmix coefficients P, C associated with two consecutive anchor points, corresponding values of the first set of coefficients Q. The computed values are supplied to a first interpolator 107 which performs interpolation of the first set of coefficients Q between the two consecutive anchor points, e.g. by interpolating a value of the first set of coefficients Q for at least one point in time comprised between the consecutive anchor points based on the values of the first set of coefficients Q already computed. The interpolation scheme employed may for example be linear interpolation. Alternatively, steep interpolation may be employed, where old values for the first set of coefficients Q are kept in use until a certain point in time, e.g. indicated in the metadata encoded in the bitstream B, at which new values for the first set of coefficients Q are to replace the old values. Interpolation may also be employed on the wet and dry upmix coefficients P, C themselves. A second interpolator 108 may receive multiple values of the wet upmix coefficients and may perform time interpolation before supplying the wet upmix coefficients P to the wet upmix section 103. Similarly, a third interpolator 109 may receive multiple values of the dry upmix coefficients C and may perform time interpolation before supplying the dry upmix coefficients C to the dry upmix section 104. The interpolation scheme employed for the wet and dry upmix coefficients P, C may be the same interpolation scheme as employed for the first set of coefficients Q, or may be a different interpolation scheme.

Figure 2:
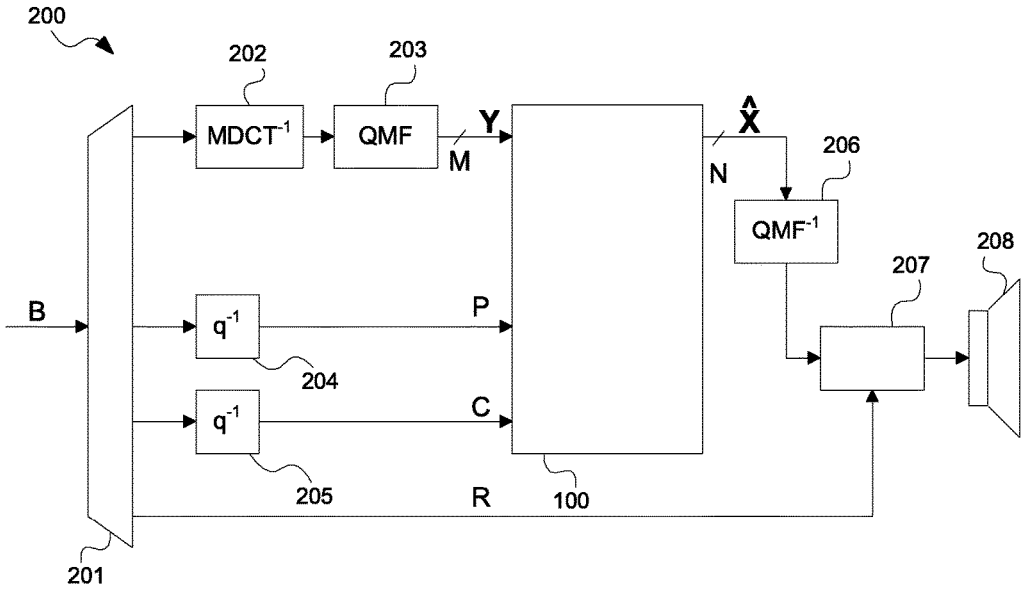
FIG. 2 is a generalized block diagram of an audio decoding system comprising the parametric reconstruction section depicted in FIG. 1, according to an example embodiment.

FIG. 2 is a generalized block diagram of an audio decoding system 200 according to an example embodiment. The audio decoding system 200 comprises the parametric reconstruction section 100 described with reference to FIG. 1. A receiving section 201, e.g. including a demultiplexer, receives the bitstream B transmitted from the audio encoding system 400 described with reference to FIG. 4, and extracts the downmix signal Y and the associated dry upmix coefficients C and wet upmix coefficients P from the bitstream B. In case the downmix signal Y is encoded in the bitstream B using a perceptual audio codec such as Dolby Digital or MPEG AAC, the audio decoding system 200 may comprise a core decoder (not shown in FIG. 2) configured to decode the downmix signal Y when extracted from the bitstream B. A transform section 202 transforms the downmix signal Y by performing inverse MDCT and a QMF analysis section 203 transforms the downmix signal Y into a QMF domain for processing by the parametric reconstruction section 100 of the downmix signal Y in the form of time/frequency tiles. Dequantization sections 204 and 205 dequantize the dry upmix coefficients C and wet upmix coefficients P, e.g., from an entropy coded format, before supplying them to the parametric reconstruction section 100. As described with reference to FIG. 4, quantization may have been performed with one of two different step sizes, e.g. 0.1 or 0.2. The actual step size employed may be predefined, or may be signaled to the audio decoding system 200 from the encoder side, e.g. via the bitstream B.

In the present example embodiment, the multidimensional reconstructed audio signal $\hat{X}$ output by the parametric reconstruction section 100 is transformed back from the QMF domain by a QMF synthesis section 206 and is then provided to a renderer 207. In the present example embodiment, the audio signals X to be reconstructed include audio object signals associated with time-variable spatial positions. Rendering metadata R, including spatial locators for the audio objects, may have been encoded in the bitstream B on an encoder side, and the receiving section 201 may extract the rendering metadata R and provide it to the renderer 207. Based on the reconstructed audio signals $\hat{X}$ and the rendering metadata R, the renderer 207 renders the reconstructed audio signals $\hat{X}$ to output channels of the renderer 207 in a format suitable for playback on a multi-speaker system 208. The renderer 207 may for example be comprised in the audio decoding system 200, or may be a separate device which receives input data from the audio decoding system 200.

III. Equivalents, Extensions, Alternatives and Miscellaneous

Further embodiments of the present disclosure will become apparent to a person skilled in the art after studying the description above. Even though the present description and drawings disclose embodiments and examples, the disclosure is not restricted to these specific examples. Numerous modifications and variations can be made without departing from the scope of the present disclosure, which is defined by the accompanying claims. Any reference signs appearing in the claims are not to be understood as limiting their scope.

Additionally, variations to the disclosed embodiments can be understood and effected by the skilled person in practicing the disclosure, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The devices and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer.

The invention claimed is:

1. A method for reconstructing a plurality of audio signals, comprising:

receiving a time/frequency tile of a downmix signal together with associated wet and dry upmix coefficients, wherein the downmix signal comprises fewer channels than the number of audio signals to be reconstructed;

computing an intermediate signal as a linear mapping of the downmix signal, wherein a first set of coefficients is applied to the channels of the downmix signal;

generating a decorrelated signal by processing one or more channels of the intermediate signal;

computing a wet upmix signal as a linear mapping of the decorrelated signal, wherein a second set of coefficients is applied to one or more channels of the decorrelated intermediate signal;

computing a dry upmix signal as a linear mapping of the downmix signal, wherein a third set of coefficients is applied to the channels of the downmix signal; and combining the wet and dry upmix signals to obtain a multidimensional reconstructed signal corresponding to a time/frequency tile of said plurality of audio signals to be reconstructed, wherein said second and third sets of coefficients coincide with, or are derived from, the received wet and dry upmix coefficients, respectively, wherein the method comprises computing said first set of coefficients based on the received wet and dry upmix coefficients such that the intermediate signal, which is to be processed into the decorrelated signal, is obtained by a linear mapping of the dry upmix signal.

2. The method of claim 1, wherein the intermediate signal is obtainable by mapping the dry upmix signal by applying a set of coefficients being absolute values of the wet upmix coefficients.

3. The method of claim 1, wherein said first set of coefficients is computed by processing the wet upmix coefficients according to a predefined rule, and multiplying the processed wet upmix coefficients and the dry upmix coefficients.

4. The method of claim 3, wherein said predefined rule for processing the wet upmix coefficients includes an element-wise absolute value operation.

5. The method of claim 4, wherein the wet and dry upmix coefficients are arranged as respective matrices, and said predefined rule for processing the wet upmix coefficients includes computing element-wise absolute values of all elements and rearranging the elements to allow direct matrix multiplication with the matrix of dry upmix coefficients.

6. The method of claim 1, wherein said steps of computing and combining are performed on a quadrature mirror filter, QMF, domain representation of the signals.

7. The method of claim 1, wherein a plurality of values of said wet and dry upmix coefficients are received, each value being associated with an anchor point, the method further comprising:

computing, based on values of the wet and dry upmix coefficients associated with two consecutive anchor points, corresponding values of said first set of coefficients, then interpolating a value of the first set of coefficients for at least one point in time comprised between said consecutive anchor points based on the values of the first set of coefficients already computed.

8. The method of claim 1, wherein at least one in said plurality of audio signals relates to an audio object signal associated with a spatial locator.

9. An audio decoding system with a parametric reconstruction section adapted to receive a time/frequency tile of a downmix signal and associated wet and dry upmix coefficients, and to reconstruct a plurality of audio signals, wherein the downmix signal has fewer channels than the number of audio signals to be reconstructed, the parametric reconstruction section comprising:

a pre-multiplier configured to receive the time/frequency tile of the downmix signal and to output an intermediate signal computed by mapping the downmix signal linearly in accordance with a first set of coefficients;

a decorrelating section configured to receive the intermediate signal and to output, based thereon, a decorrelated signal;

a wet upmix section configured to receive the wet upmix coefficients as well as the decorrelated signal, and to compute a wet upmix signal by mapping the decorrelated signal linearly in accordance with the wet upmix coefficients;

a dry upmix section configured to receive the dry upmix coefficients and, in parallel to the pre-multiplier, the time/frequency tile of the downmix signal, and to output a dry upmix signal computed by mapping the downmix signal linearly in accordance with the dry upmix coefficients; and a combining section configured to receive the wet upmix signal and the dry upmix signal and to combine these signals to obtain a multidimensional reconstructed signal corresponding to a time/frequency tile of said plurality of audio signals to be reconstructed, wherein the parametric reconstruction section further comprises a converter configured to receive the wet and dry upmix coefficients, to compute the first set of coefficients and to supply this to the pre-multiplier, and wherein the converter is configured to compute said first set of coefficients based on the wet and dry upmix coefficients such that said intermediate signal is obtained by a linear mapping of the dry upmix signal.

10. A method for encoding a plurality of audio signals as data suitable for parametric reconstruction, comprising:

receiving a time/frequency tile of said plurality of audio signals;

computing a downmix signal by forming linear combinations of the audio signals according to a downmixing rule, wherein the downmix signal comprises fewer channels than the number of audio signals to be reconstructed;

determining dry upmix coefficients in order to define a linear mapping of the downmix signal approximating the audio signals to be encoded in the time/frequency tile;

determining wet upmix coefficients based on a covariance of the audio signals as received and a covariance of the audio signals as approximated by the linear mapping of the downmix signal; and outputting the downmix signal together with the wet and dry upmix coefficients, which coefficients on their own enable decoder-side computation according to a predefined rule of a further set of coefficients defining a pre-decorrelation linear mapping as part of parametric reconstruction of the audio signals, wherein the wet upmix coefficients are determined by:

setting a target covariance to supplement the covariance of the audio signals as approximated by the linear mapping of the downmix signal; and decomposing the target covariance as a product of a matrix and its own transpose, wherein the elements of said matrix, after column-wise rescaling, correspond to the wet upmix coefficients.

11. The method of claim 10, wherein a plurality of time/frequency tiles of the audio signals is received, and the downmix signal is computed uniformly according to a predefined downmixing rule.

12. The method of claim 10, wherein a plurality of time/frequency tiles of the audio signals is received, and the downmix signal is computed according to a signal-adaptive downmixing rule.

13. The method of claim 10, further comprising column-wise rescaling of said matrix, into which the target covariance is decomposed, wherein the column-wise rescaling ensures that the variance of each signal resulting from an application of said pre-decorrelation linear mapping to the downmix signal is equal to the inverse square of a corresponding rescaling factor employed in the column-wise rescaling provided the coefficients defining the pre-decorrelation linear mapping are computed in accordance with the predefined rule.

14. The method of claim 13, wherein said predefined rule implies a linear scaling relationship between the further set of coefficients and the wet coefficients, wherein the column-wise rescaling amounts to multiplication by the diagonal part of the matrix product.

15. The method of claim 10, wherein the target covariance is chosen in order for the sum of the target covariance and the covariance of the audio signals as approximated by the linear mapping of the downmix signal to approximate the covariance of the audio signals as received.

16. The method of claim 10, further comprising performing energy compensation by:

determining a ratio of an estimated total energy of the audio signals as received and an estimated total energy of the audio signals as parametrically reconstructed based on the downmix signal, the wet upmix coefficients and the dry upmix coefficients; and rescaling the dry upmix coefficients by the inverse square root of said ratio, wherein the rescaled dry upmix coefficients are output together with the downmix signal and the wet upmix coefficients.

17. An audio encoding system including a parametric encoding section adapted to encode a plurality of audio signals as data suitable for parametric reconstruction, the parametric encoding section comprising:

a downmix section configured to receive a time/frequency tile of said plurality of audio signals and to compute a downmix signal by forming linear combinations of the audio signals according to a downmixing rule, wherein the downmix signal comprises fewer channels than the number of audio signals to be reconstructed;

a first analyzing section configured to determine dry upmix coefficients in order to define a linear mapping of the downmix signal approximating the audio signals to be encoded in the time/frequency tile; and a second analyzing section configured to determine wet upmix coefficients based on a covariance of the audio signals as received and a covariance of the audio signals as approximated by the linear mapping of the downmix signal, wherein the parametric encoding section is configured to output the downmix signal together with the wet and dry upmix coefficients, which coefficients on their own enable decoder-side computation according to a predefined rule of a further set of coefficients defining a pre-decorrelation linear mapping as part of parametric reconstruction of the audio signals, and wherein the second analyzing section is further configured to determine the wet upmix coefficients by:

setting a target covariance to supplement the covariance of the audio signals as approximated by the linear mapping of the downmix signal; and decomposing the target covariance as a product of a matrix and its own transpose, wherein the elements of said matrix, after column-wise rescaling, correspond to the wet upmix coefficients.

18. A computer program product comprising a non-transitory computer-readable medium with instructions for performing the method of claim 1.

* * * * *